US007847757B2

(12) United States Patent
Urakami et al.

(10) Patent No.: US 7,847,757 B2
(45) Date of Patent: Dec. 7, 2010

(54) DISPLAY DEVICE

(75) Inventors: Hiroyuki Urakami, Tokyo (JP); Hirofumi Honda, Tokyo (JP); Takashi Okushima, Tokyo (JP); Tetsuya Shigeta, Yamanashi-ken (JP); Tetsuro Nagakubo, Tokyo (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 621 days.

(21) Appl. No.: 10/733,304

(22) Filed: Dec. 12, 2003

(65) Prior Publication Data

US 2004/0150586 A1 Aug. 5, 2004

(30) Foreign Application Priority Data

Feb. 5, 2003 (JP) ..... 2003-028181

(51) Int. Cl.
*G09G 3/28* (2006.01)

(52) U.S. Cl. ..... 345/60; 315/169.4; 345/690

(58) Field of Classification Search ..... 345/60, 345/63, 76, 87, 204, 690–692, 72; 315/169.1–169.4
See application file for complete search history.

(56) References Cited

U.S. PATENT DOCUMENTS

| | | | | |
|---|---|---|---|---|
| 6,127,991 | A | 10/2000 | Uehara et al. | |
| 6,476,781 | B1 * | 11/2002 | Suzuki et al. | 345/60 |
| 6,950,114 | B2 * | 9/2005 | Honda et al. | 345/626 |
| 2001/0011976 | A1 | 8/2001 | Kasahara et al. | |
| 2002/0005842 | A1 * | 1/2002 | Honda et al. | 345/204 |
| 2002/0030672 | A1 | 3/2002 | Honda et al. | |
| 2003/0122743 | A1 * | 7/2003 | Suzuki | 345/63 |

FOREIGN PATENT DOCUMENTS

| | | |
|---|---|---|
| EP | 0 560 056 | 9/1993 |
| JP | 10-055151 | 2/1998 |
| JP | 10-161589 | 6/1998 |
| JP | 11-065520 | 3/1999 |
| JP | 11-119730 | 4/1999 |
| JP | 11-272228 | 10/1999 |
| JP | 2000-035774 | 2/2000 |
| JP | 2001067041 A * | 3/2001 |
| JP | 2001-306020 | 11/2001 |

* cited by examiner

*Primary Examiner*—Stephen G Sherman
(74) *Attorney, Agent, or Firm*—Drinker Biddle & Reath LLP

(57) ABSTRACT

Prepared is brightness frequency data that indicates the number of pixels, having the same brightnesses in a brightness distribution for each of the fields represented by an input image signal. Based on the brightness frequency data, the number of subfields for emission at each brightness in a brightness region is adjusted for each of at least two brightness regions. As a result, the greater the frequency indicating the total number of pixels at each of the same brightnesses in a brightness region, the larger the number of subfields allocated to that brightness region. Therefore, satisfactory gray-scale representation suitable to human visual characteristics is achieved.

3 Claims, 8 Drawing Sheets

FIG. 3

| GRAYSCALE | CONVERSION TABLE | | | | | | | | | | | | | EMISSION DRIVING PATTERN | | | | | | | | | | | |
|---|---|---|---|---|---|---|---|---|---|---|---|---|---|---|---|---|---|---|---|---|---|---|---|---|---|
| | MD | GD | | | | | | | | | | | | SF | SF | SF | SF | SF | SF | SF | SF | SF | SF | SF | SF |
| | | 1 | 2 | 3 | 4 | 5 | 6 | 7 | 8 | 9 | 10 | 11 | 12 | 1 | 2 | 3 | 4 | 5 | 6 | 7 | 8 | 9 | 10 | 11 | 12 |
| 1 | 0000 | 1 | * | * | * | * | * | * | * | * | * | * | * | ● | | | | | | | | | | | |
| 2 | 0001 | 0 | 1 | * | * | * | * | * | * | * | * | * | * | ○ | ● | | | | | | | | | | |
| 3 | 0010 | 0 | 0 | 1 | * | * | * | * | * | * | * | * | * | ○ | ○ | ● | | | | | | | | | |
| 4 | 0011 | 0 | 0 | 0 | 1 | * | * | * | * | * | * | * | * | ○ | ○ | ○ | ● | | | | | | | | |
| 5 | 0100 | 0 | 0 | 0 | 0 | 1 | * | * | * | * | * | * | * | ○ | ○ | ○ | ○ | ● | | | | | | | |
| 6 | 0101 | 0 | 0 | 0 | 0 | 0 | 1 | * | * | * | * | * | * | ○ | ○ | ○ | ○ | ○ | ● | | | | | | |
| 7 | 0110 | 0 | 0 | 0 | 0 | 0 | 0 | 1 | * | * | * | * | * | ○ | ○ | ○ | ○ | ○ | ○ | ● | | | | | |
| 8 | 0111 | 0 | 0 | 0 | 0 | 0 | 0 | 0 | 1 | * | * | * | * | ○ | ○ | ○ | ○ | ○ | ○ | ○ | ● | | | | |
| 9 | 1000 | 0 | 0 | 0 | 0 | 0 | 0 | 0 | 0 | 1 | * | * | * | ○ | ○ | ○ | ○ | ○ | ○ | ○ | ○ | ● | | | |
| 10 | 1001 | 0 | 0 | 0 | 0 | 0 | 0 | 0 | 0 | 0 | 1 | * | * | ○ | ○ | ○ | ○ | ○ | ○ | ○ | ○ | ○ | ● | | |
| 11 | 1010 | 0 | 0 | 0 | 0 | 0 | 0 | 0 | 0 | 0 | 0 | 1 | * | ○ | ○ | ○ | ○ | ○ | ○ | ○ | ○ | ○ | ○ | ● | |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ |

*: 0 OR 1

● : SELECTED ERASE DISCHARGE

○ : EMISSION SF

DISPLAY DEVICE

BACKGROUND OF THE INVENTION

1. Field of the Invention

The present invention relates to a display device which utilizes the subfield method to represent the brightness of halftones.

2. Description of the Related Art

Currently, display devices equipped with plasma display panels (hereafter called "PDPs") or electroluminescence display panels (hereafter "ELDPs") as thin-type planar display panels are known. In these PDPs and ELDPs, the emission elements in each pixel have only two states, "emitting" and "non-emitting". Hence in order to obtain brightnesses of halftones corresponding to an input image signal, the subfield method is used in grayscale driving (multi-gradation level driving) of the display panels.

In the subfield method, an input image signal is converted into N bits of pixel data for each pixel, and the display period for one field is divided into N subfields corresponding to the N bits. To each subfield is allocated a number of emissions corresponding to the associated bit of the pixel data. When for example the logic level of one bit among the N bits is "1", emission is executed in the subfield associated with that bit, the number of times allocated to that subfield. On the other hand, when the logic level of the bit is "0", emission is not performed in the subfield associated with that bit. By means of this driving method, the brightness of halftones corresponding to the input image signal is represented by the sum of the number of times emission is executed in all the subfields within one field display period.

SUMMARY OF THE INVENTION

One object of this invention is to provide a display device which, in representing halftone brightness using the subfield method, can satisfactorily represent grayscales that fit to the vision characteristics of humans.

According to one aspect of the present invention, there is provided an improved display device. Each field of an image signal is divided into a plurality of subfields. A display panel of the display device includes a plurality of pixel cells for each pixel. Grayscale display is performed by selectively causing emission in the pixel cells based on the image signal for each of the subfields. The display device includes a brightness frequency data circuit for generating brightness frequency data indicating a number of pixels having the same brightnesses in a brightness distribution for each field of the image signal. The display device also includes a controller for adjusting, for each of at least two brightness regions, a number of subfields for emission at each brightness within each brightness region, based on the brightness frequency data of the brightness concerned.

According to another aspect of the present invention, there is provided another improved display device. A display panel of the display device includes a plurality of pixel cells for each pixel. Each field of an image signal is divided into a plurality of subfields. The display device performs grayscale display by causing emission in the pixel cells of the display panel, in each of the subfields, based on pixel data of the pixels derived from the image signal. The display device includes a brightness frequency data circuit for generating brightness frequency data indicating a number of pixels having the same brightnesses in a brightness distribution for each field of the image signal. The display device also includes a logarithmic conversion circuit for performing logarithmic conversion processing on the brightness frequency data to generate logarithmic-converted brightness frequency data. The display device also includes a clipping circuit for generating level-limited brightness frequency data, by converting the logarithmic-converted brightness frequency data into a prescribed upper limit if the logarithmic-converted brightness frequency data exceeds the prescribed upper limit, and by converting the logarithmic-converted brightness frequency data into a prescribed lower limit if the logarithmic-converted brightness frequency data is smaller than the prescribed lower limit. The display device also includes a cumulative brightness frequency data circuit for obtaining cumulative brightness frequency data corresponding to each brightness level, by accumulating the level-limited brightness frequency data of each brightness level, in the order of increasing or of decreasing brightness levels. The display device also includes a delimiter value generation circuit for determining a delimiter value for each neighboring subfields, based on the cumulative brightness frequency data. The display device also includes a driving controller for grayscale driving of the pixel cells through each of the subfields, which are set using the delimiter values.

Other objects, aspects and advantages of the present invention will become apparent to those skilled in the art to which the present invention relates from the subsequent detailed description and the appended claims, taken in conjunction with the accompanying drawings.

BRIEF DESCRIPTION OF THE DRAWINGS

FIG. 3 illustrates a data conversion table and emission driving pattern table, used by a driving data conversion circuit shown in FIG. 1;

DETAILED DESCRIPTION OF THE INVENTION

Figure 1:
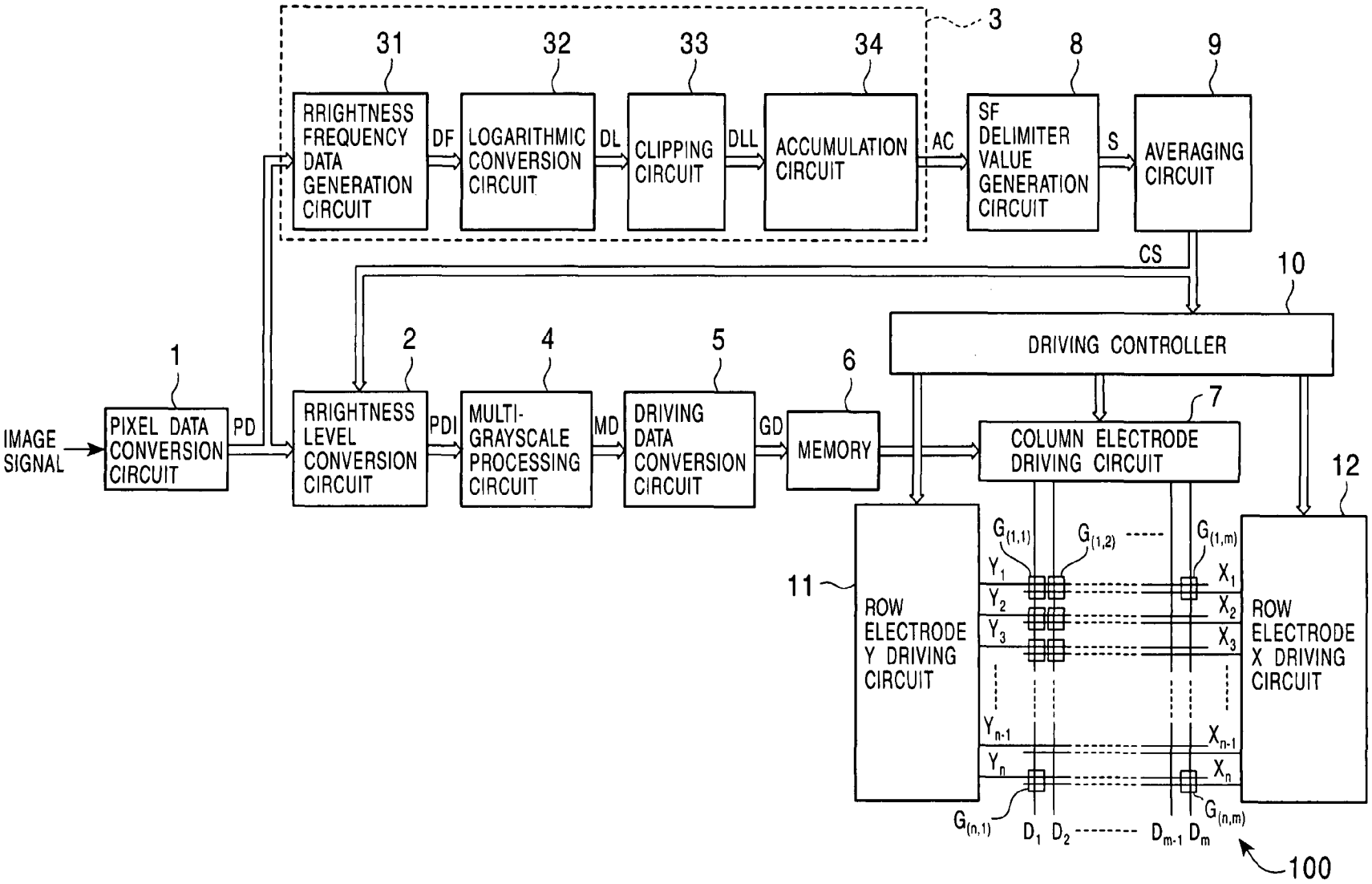
FIG. 1 shows a block diagram of a plasma display device according to one embodiment of the present invention.

Below, embodiments of the present invention will be described, referring to the drawings.

Referring to FIG. 1, the configuration of a display device equipped with a plasma display panel according to one embodiment of the present invention is described.

In FIG. 1, the PDP (plasma display panel) 100 includes a front substrate (not shown) which serves as the display face (display screen), and a back substrate (not shown) arranged in a position facing the front substrate. The front and back substrate enclose a discharge space therebetween, which is filled with a discharge gas. On the front substrate are formed strip-shaped row electrodes $X_1$ to $X_n$ and row electrodes $Y_1$ to $Y_n$, arranged in alternating parallel rows. On the back substrate are formed strip-shaped column electrodes $D_1$ to $D_m$, arranged so as to intersect with the row electrodes $X_1$ to $X_n$ and $Y_1$ to $Y_n$. The row electrodes $X_1$ to $X_n$ and $Y_1$ to $Y_n$ are structured such that each of the first through nth display lines of the PDP 100 is defined by a pair of row electrodes X and Y, and a discharge cell G serving as part of a pixel is formed at the intersection (including the discharge space) of each row electrode pair with each column electrode. That is, in the PDP 100, a matrix of (n×m) discharge cells $G_{(1,1)}$ to $G_{(n,m)}$ is formed.

The pixel data conversion circuit 1 converts an input image signal into, for example, 8 bits of pixel data PD which represent the brightness levels of the respective pixels. The pixel data are supplied to the brightness level conversion circuit 2 and brightness cumulative frequency computation circuit 3.

The brightness level conversion circuit 2 converts the pixel data PD, which uses 8 bits to represent brightness levels from "0" to "255", into pixel data PD1 which uses 8 bits to represent brightness levels from "0" to "192" according to the conversion characteristic curves shown in FIG. 2, based on average SF delimiter values CS1 to CS12 (will be described). The pixel data PD1 are supplied to the multi-grayscale processing circuit 4.

The multi-grayscale processing circuit 4 performs error diffusion processing and dither processing on the 8-bit pixel data PD1. For example, in the error diffusion processing, the upper 6 bits of the pixel data PD1 are regarded as display data, and the remaining lower 2 bits are regarded as error data. The error data among the pixel data PD1 corresponding to the surrounding pixels are weighted and reflected in the display data. Through this operation, the brightness of the lower 2 bits of each original pixel is pseudo-represented by the surrounding pixels, and consequently only 6 bits of display data, fewer than the original 8 bits, can represent brightness grayscales equivalent to the 8 bits of pixel data. Then, the 6 bits of error-diffused pixel data obtained by this error diffusion processing are subjected to dither processing. In dither processing, a plurality of neighboring pixels are regarded as one pixel unit, and dither coefficients consisting of different coefficient values are allocated and added to the error-diffused pixel data corresponding to the respective pixels within one pixel unit, to obtain dither-added pixel data. By adding these dither coefficients, when one pixel unit is viewed, brightness equivalent to 8 bits can be represented using only the upper 4 bits of the dither-added pixel data. Hence, the multi-grayscale processing circuit 4 supplies the upper 4 bits of the dither-added pixel data to the driving data conversion circuit 5 as multi-grayscale pixel data MD.

The driving data conversion circuit 5 converts the multi-grayscale pixel data MD into 12 bits of pixel driving data GD according to a data conversion table shown in FIG. 3, and supplies the result to the memory 6.

The memory 6 receives and stores 12-bit pixel driving data GD. Each time the writing of one frame's worth (n rows×m columns) of pixel driving data $GD_{1,1}$ to $GD_{n,m}$ ends, the memory 6 separates each of the pixel driving data $GD_{1,1}$ to $GD_{n,m}$ into bits (first through 12th bits), finds the corresponding subfields SF1 to SF12, and reads one display line at a time. The memory 6 supplies the pixel driving data bits for one display line (m bits) to the column electrode driving circuit 7 as pixel driving data bits DB1 to DBm. For example, in the subfield SF1, the memory 6 reads the first bit only of each of the pixel driving data $GD_{1,1}$ to $GD_{n,m}$ for one display line at a time, and supplies the group of the first bits to the column electrode driving circuit 7 as pixel driving data bits DB1 to DBm. Next, in the subfield SF2, the memory 6 reads the second bit only of each of the pixel driving data $GD_{1,1}$ to $GD_{n,m}$ for one display line at a time, and supplies the group of second bits to the column electrode driving circuit 7 as pixel driving data bits DB1 to DBm.

The brightness cumulative frequency computation circuit 3 includes the brightness frequency data generation circuit 31, logarithmic conversion circuit 32, clipping circuit 33, and accumulation circuit 34.

The brightness frequency data generation circuit 31 includes 256 storage regions, associated with the 256 brightness levels from "0" to "255" which can be represented by the pixel data PD. Each of the 256 storage regions stores the total number of times pixel data PD representing the associated brightness level has been supplied, that is, the frequency. For example, each time pixel data PD is supplied from the pixel data conversion circuit 1, the brightness frequency data generation circuit 31 increments by 1 the frequency stored in the storage region corresponding to the brightness level represented by the pixel data PD. Then, for each field of the input image signal, the brightness frequency data generation circuit 31 supplies, to the logarithmic conversion circuit 32, brightness frequency data $DF_0$ to $DF_{255}$ respectively representing the frequencies for the brightness levels from "0" to "255" generated by one field's worth of pixel data PD.

The logarithmic conversion circuit 32 performs the logarithmic conversion processing, indicated by the equation below, on each of the brightness frequency data $DF_0$ to $DF_{255}$, and supplies the resulting logarithmic-converted brightness frequency data $DL_0$ to $DL_{255}$ to the clipping circuit 33.

$$DL=\log_2|DF|$$

The clipping circuit 33 performs level limiting processing on each of the logarithmic-converted brightness frequency data $DL_0$ to $DL_{255}$, using bottom clipping values $C_B$ and top clipping values $C_T$ ($C_B<C_T$), and supplies the resulting level-limited brightness frequency data $DLL_0$ to $DLL_{255}$ to the accumulation circuit 34. Specifically, the clipping circuit 33 converts the logarithmic-converted brightness frequency data DL into the bottom clipping value $C_B$ when the data DL is smaller than the bottom clipping value $C_B$, and takes the result as the level-limited brightness frequency data DLL. The clipping circuit 33 converts the logarithmic-converted brightness frequency data DL into the top clipping value $C_T$ when the data DL is greater than the top clipping value $C_T$, and takes the result as the level-limited brightness frequency data DLL. When the logarithmic-converted brightness frequency data DL is smaller than the top clipping value $C_T$ and also greater than the bottom clipping value $C_B$, the data DL is taken without change to be the level-limited brightness frequency data DLL. The clipping circuit 33 determines the average value of each of the logarithmic-converted brightness frequency data $DL_0$ to $DL_{255}$, and uses the result as the bottom clipping value $C_B$. If the difference between neighboring average SF delimiter values CS, that is, the range of display brightnesses for one subfield (brightness division or brightness region or extent of brightnesses) exceeds a predetermined limit value, the clipping circuit 33 modifies the top clipping value $C_T$ so that the difference between the neighboring average SF delimiter values CS is within the predetermined limit value.

The accumulation circuit 34 performs sequential addition of each of the level-limited brightness frequency data $DLL_0$ to $DLL_{255}$ starting from the lowest level of brightness (or from the highest level of brightness), and determines each addition result as the cumulative brightness frequency data $AC_0$ to $AC_{255}$ associated with the brightness levels "0" to "255" respectively. That is, the accumulation circuit 34 performs the computations shown below:

$$AC_0=DLL_0$$

$$AC_1=DLL_0+DLL_1$$

$$AC_2=DLL_0+DLL_1+DLL_2$$

$$AC_{255}=DLL_0+DLL_1+DLL_2+DLL_3+\ldots+DLL_{255}$$

As a result, the accumulation circuit 34 provides the cumulative brightness frequency data $AC_0$ to $AC_{255}$ indicating the cumulative frequencies of brightnesses corresponding to the brightness levels "0" to "255". The accumulation circuit 34 supplies these cumulative brightness frequency data $AC_0$ to $AC_{255}$ to the SF (subfield) delimiter value generation circuit 8.

The SF delimiter value generation circuit 8 first determines whether the value (frequency) of the cumulative brightness frequency data AC (each of $AC_0$ to $AC_{255}$) is greater than each of thresholds R1 to R11 (R1<R2<R3<R4<R5<R6<R7<R8<R9<R10<R11) in the order of the cumulative brightness frequency data $AC_0$ to $AC_{255}$. In this operation, the SF delimiter value generation circuit 8 supplies the brightness level associated with that cumulative brightness frequency data AC which is first determined to be larger than the first threshold R1, to the averaging circuit 9 as the SF delimiter value S1. The SF delimiter value S1 is a value to delimit the subfields SF1 and SF2. Then, the SF delimiter value generation circuit 8 supplies the brightness level associated with the cumulative brightness frequency data AC which is first determined to be larger than the threshold value R2, to the averaging circuit 9 as the SF delimiter value S2. The SF delimiter value S2 is a value to delimit the subfields SF2 and SF3. The SF delimiter value generation circuit 8 supplies the brightness level associated with the cumulative brightness frequency data AC which is first determined to be larger than the threshold value R3 to the averaging circuit 9 as the SF delimiter value S3, which delimits the subfields SF3 and SF4. In a similar manner, the SF delimiter value generation circuit 8 determines the SF delimiter values S4 to S11 for the subfields SF4 to SF12 and supplies the delimiter values to the averaging circuit 9.

The averaging circuit 9 performs individual averaging of the SF delimiter values S1 to S11 and supplies the obtained averaged subfield delimiter values CS1 to CS11 to the brightness level conversion circuit 2 and driving control circuit 10. For example, the averaging circuit 9 includes a cyclic low-pass filter. The averaging circuit 9 performs cyclic low-pass filtering, using the SF delimiter value S1 generated based on the image signal for the previous field and the SF delimiter value S1 generated based on the image signal for the current field, and supplies the resulting value, as the averaged SF delimiter value CS1, to the brightness level conversion circuit 2 and driving control circuit 10. The averaging circuit 9 also performs cyclical low-pass filtering, using the SF delimiter value S2 generated based on the image signal for the previous field and the SF delimiter value S2 generated based on the image signal for the current field, and supplies the resulting value, as the averaged SF delimiter value CS2, to the brightness level conversion circuit 2 and driving control circuit 10. The averaging circuit 9 also performs cyclical low-pass filtering, using the generated SF delimiter value S3 based on the image signal for the previous field and the generated SF delimiter value S3 based on the image signal for the current field, and supplies the resulting value, as the averaged SF delimiter value CS3, to the brightness level conversion circuit 2 and driving control circuit 10. Similarly, the averaging circuit 9 performs the cyclical low-pass filtering individually for each of the SF delimiter values S4 to S11, and supplies the averaged SF delimiter values CS4 to CS11 to the brightness level conversion circuit 2 and driving control circuit 10.

Figure 4:
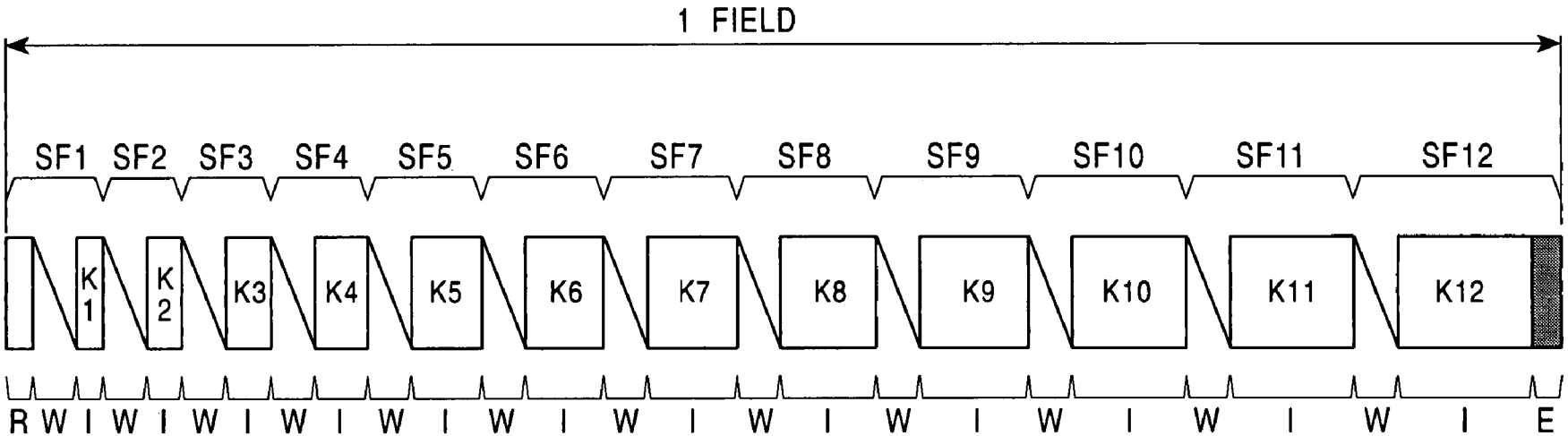
FIG. 4 illustrates one example of an emission driving sequence when driving the PDP shown in FIG. 1.

The driving control circuit 10 supplies various timing signals to the column electrode driver circuit 7, row electrode Y driver circuit 11 and row electrode X driver circuit 12, for the purpose of grayscale driving of the PDP 100 according to an emission driving sequence shown in FIG. 4, based on the subfield method.

In the emission driving sequence shown in FIG. 4, the display period for one field is divided into the subfields SF1 to SF12. In each subfield, an addressing process W and a sustain process I are executed in sequence. At the beginning of subfield SF1 only, a reset process R is executed prior to the addressing process W. In the final subfield SF12 only, an erase process E is executed after the sustain process I.

In the reset process R at the beginning of the subfield SF1, the row electrode Y driving circuit 11 and row electrode X driving circuit 12 apply reset pulses to all the row electrodes X and Y. In response to the reset pulses, reset discharge occurs in all the discharge cells G, and a certain amount of wall charge is formed in each discharge cell G. In this way, all the discharge cells G are set in a lighting mode, which is a state in which sustain-discharge emission is possible in a sustain process I.

In the addressing process W of each of the subfields, the row electrode Y driving circuit 11 applies scanning pulses in sequence to each of the row electrodes $Y_1$ to $Y_n$ of the PDP 100. During this time, the column electrode driving circuit 7 applies, to the column electrodes $D_1$ to $D_m$, the m pixel data pulses of one display line according to the pixel driving data bits DB1 to DBm, in sync with the scanning pulse timing. The pixel driving data bits DB1 to DBm are read from the memory 6. Erase (or extinction or elimination) address discharge occurs only in those discharge cells to which the scanning pulse and the high-voltage pixel data pulse are both applied. By means of the erase address discharge, the wall charge formed within the discharge cell is eliminated (dissipated), and the discharge cell is set to an extinction mode, which is a state in which emission-sustaining discharge (or sustained-discharge emission) does not occur in the sustain process I. On the other hand, the erase address discharge does not occur in discharge cells to which a low-voltage pixel data pulse is applied, even if the scanning pulse is applied, and the immediately preceding state (lighting mode or extinction mode) is maintained.

In the sustain process I of each of the subfields, the row electrode Y driving circuit 11 and row electrode X driving circuit 12 repeatedly generate sustain pulses throughout the emission period determined by the weighting of the subfield concerned, and apply the sustain pulses to all the row electrodes X and Y in alternation. At this time, sustain-discharge emission occurs only in those discharge cells G set to the lighting mode upon application of the sustain pulses.

If the driving scheme shown in FIG. 3 and FIG. 4 is employed, the possibility for transition of a discharge cell from the extinction mode to the lighting mode in the subfields SF1 to SF12 is limited only to the reset process R in the subfield SF1. Therefore, if the erase address discharge occurs only in one subfield among the subfields SF1 to SF12, and a discharge cell G is set to the extinction mode, the discharge cell G can never be restored to the lighting mode in the subsequent subfields. Hence, when driving is executed based on the 13 types of pixel driving data GD as shown in FIG. 3, the discharge cell G is set to the lighting mode in a number of continuous subfields corresponding to the brightness to be represented. During the time until the erase address discharge (indicated by black circles) occurs, continuous sustained-discharge emission (indicated by white circles) is induced in the sustain processes I of such subfields.

Through the above-described driving, brightness corresponding to the total emission period of sustained-discharge emission occurring within one subfield period is perceived. That is, through the 13 emission patterns shown in FIG. 3, the intermediate brightness levels of 13 grayscales, corresponding to the sum of the emission periods of the sustain processes I in the subfields indicated by the white circle, can be represented.

As shown in FIG. 4, although the period ratios among the emission periods K1 to K12 of the sustain processes I of the subfields SF1 to SF12 is maintained to be equal to the weighting ratios of the display brightness of the subfields SF1 to SF12, the actual emission periods are modified by the averaged SF delimiter values CS1 to CS11. Specifically, the driving control circuit 10 sets the emission period K to be large for a subfield if the difference between neighboring delimiter values CS is relatively large for that subfield, that is, if the range of display brightnesses (brightness division, brightness region, or extent of brightness) of that subfield is relatively large.

The modified allocation operation for the subfields of the plasma display device of FIG. 1 is described below, referring to the examples shown in FIG. 5A through FIG. 5C and FIG. 6A through FIG. 6C.

Figure 5A:
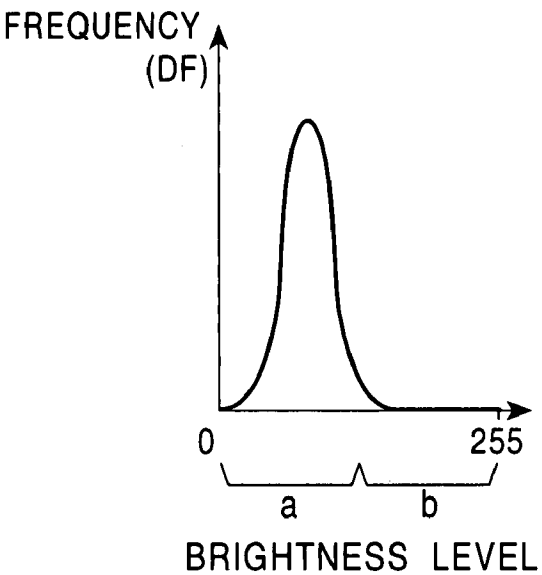
FIGS. 5A to 5C is a set of drawings used to explain one example of operation of a logarithmic conversion circuit and clipping circuit shown in FIG. 1.
Figure 5B:
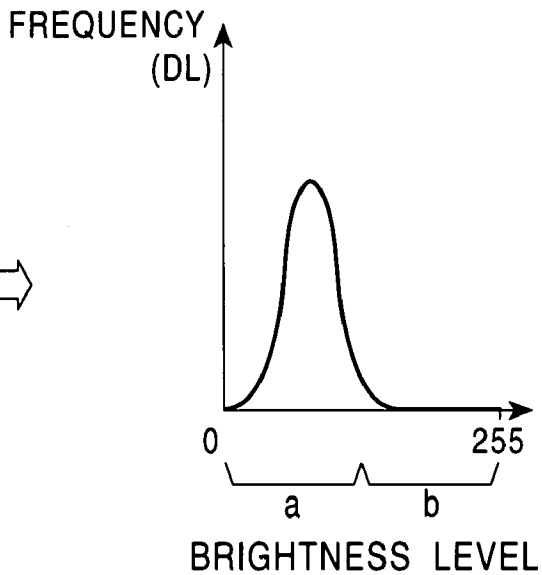
Figure 5C:
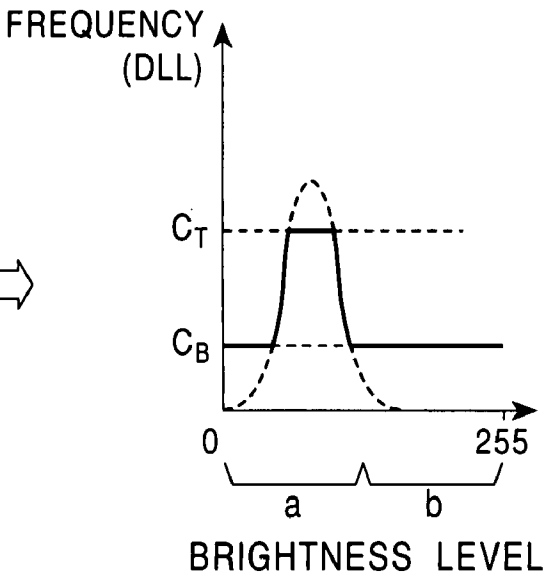
Figure 6A:
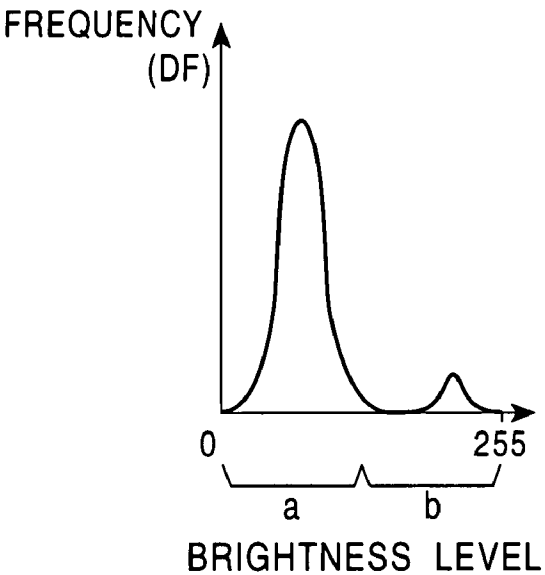
FIGS. 6A to 6C is a set of drawings used to explain another example of operation of the logarithmic conversion circuit and clipping circuit shown in FIG. 1.
Figure 6B:
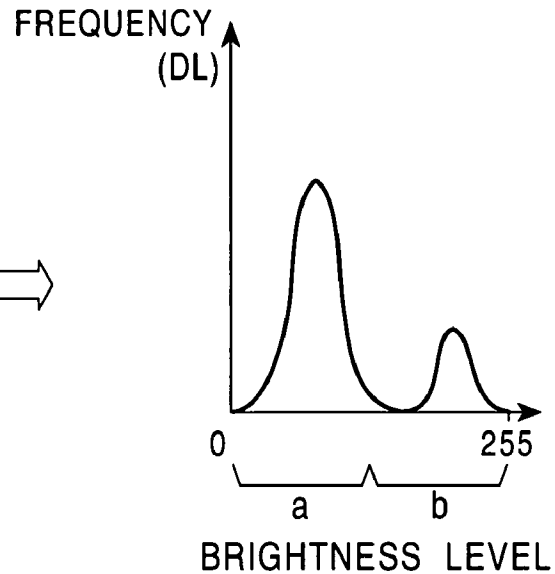

Each of FIG. 5A and FIG. 6A shows the frequency distribution of brightness in the image signal for one field. In the brightness frequency distribution shown in FIG. 5A, only one frequency peak exists within the low brightness region a below brightness level "128". On the other hand, in the brightness frequency distribution shown in FIG. 6A, a small frequency peak exists in the high brightness region b, in addition to one frequency peak in the low-brightness region a. The brightness frequency data generation circuit 31 generates brightness frequency data $DF_0$ to $DF_{255}$ expressing the frequency distribution of the brightnesses shown in FIG. 5A (or FIG. 6A). The logarithmic conversion processing is performed on the brightness frequency data $DF_0$ to $DF_{255}$ using the logarithmic conversion circuit 32. The logarithmic-converted brightness frequency data $DL_0$ to $DL_{255}$, expressing the frequency distribution shown in FIG. 5B (or FIG. 6B), is thus obtained. By means of this logarithmic conversion processing, the peak value appearing in the low brightness region a shown in FIG. 6A drops as shown in FIG. 6B, whereas the peak value appearing in the high brightness region b rises as shown in FIG. 6B. In other words, extremely large frequency peak values are suppressed, and extremely small frequency peak values are emphasized. Next, logarithmic-converted brightness frequency data $DL_0$ to $DL_{255}$ expressing a frequency distribution as shown in FIG. 5B (or FIG. 6B) is subjected to level-limiting processing by the clipping circuit 33 based on the bottom clipping value $C_B$ and top clipping value $C_T$, to obtain level-limited brightness frequency data $DLL_0$ to $DLL_{255}$ expressing a frequency distribution, as shown in FIG. 5C (or FIG. 6C).

The above described operation of the logarithmic conversion circuit 32 and clipping circuit 33 prevents the occurrence of a larger number of subfields than necessary being allocated for emission in a brightness region (for example, the low-brightness region a) containing a large frequency peak. Further, a desired number (at least certain number) of subfields are allocated for emission of brightness regions (for example, the high-brightness region b) containing small frequency peaks.

Figure 6C:
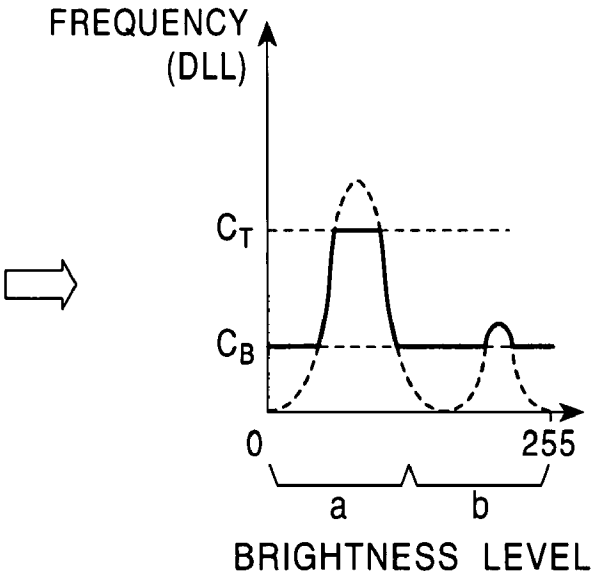
Figure 7:
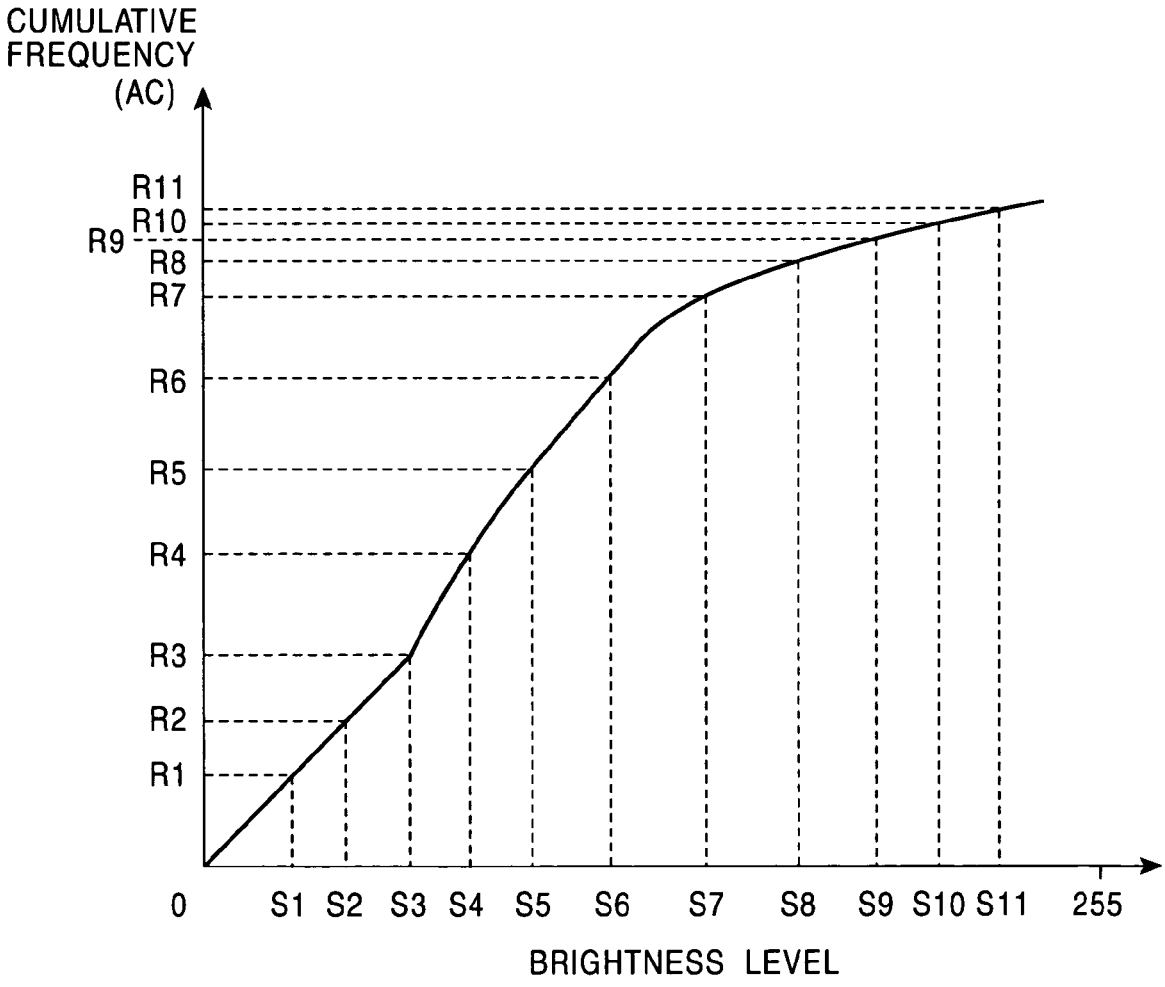
FIG. 7 depicts a graph used to explain an operation of an accumulation circuit shown in FIG. 1.

After FIG. 5C (or FIG. 6C), the accumulation circuit 34 performs the accumulation processing on the level-limited brightness frequency data $DLL_0$ to $DLL_{255}$ of FIG. 5C (or FIG. 6C). As a result, cumulative brightness frequency data $AC_0$ to $AC_{255}$ indicating the cumulative frequencies corresponding to the brightness levels "0" to "255" are obtained, as shown in FIG. 7. In this operation, the SF delimiter value generation circuit 8 takes the brightness level at which the cumulative frequency, indicated by the cumulative brightness frequency data $AC_0$ to $AC_{255}$, is greater than the threshold R1 to be the SF delimiter value S1, the brightness level at which the cumulative frequency is greater than the threshold R2 to be the SF delimiter value S2, and so on, as shown in FIG. 7. Finally, the brightness level at which the cumulative frequency is greater than the threshold R11 is taken to be the SF delimiter value S11, as shown in FIG. 7. The averaging circuit 9 averages each of the SF delimiter values S1 to S11 individually to obtain the averaged SF delimiter values CS1 to CS11. Through this averaging, abrupt changes in grayscales are suppressed, and so the occurrence of flicker is restrained.

The brightness level conversion circuit 2 executes brightness level conversion of the pixel data PD using the conversion characteristic represented by the averaged SF delimiter values CS1 to CS11. That is, in the brightness level conversion circuit 2, first the brightness range from "0" to "255" expressed by the input image signal is divided into 12 brightness regions YR1 to YR12, corresponding to the subfields SF1 to SF12, as shown in FIG. 2. Then, brightness levels at the boundaries between neighboring brightness regions YR are extracted, and a conversion characteristic curve is adopted such that the values after conversion, PD1, which correspond to the extracted brightness levels, match the averaged SF delimiter values CS1 to CS11, respectively. Brightness level conversion of the pixel data PD is then executed.

Figure 8A:
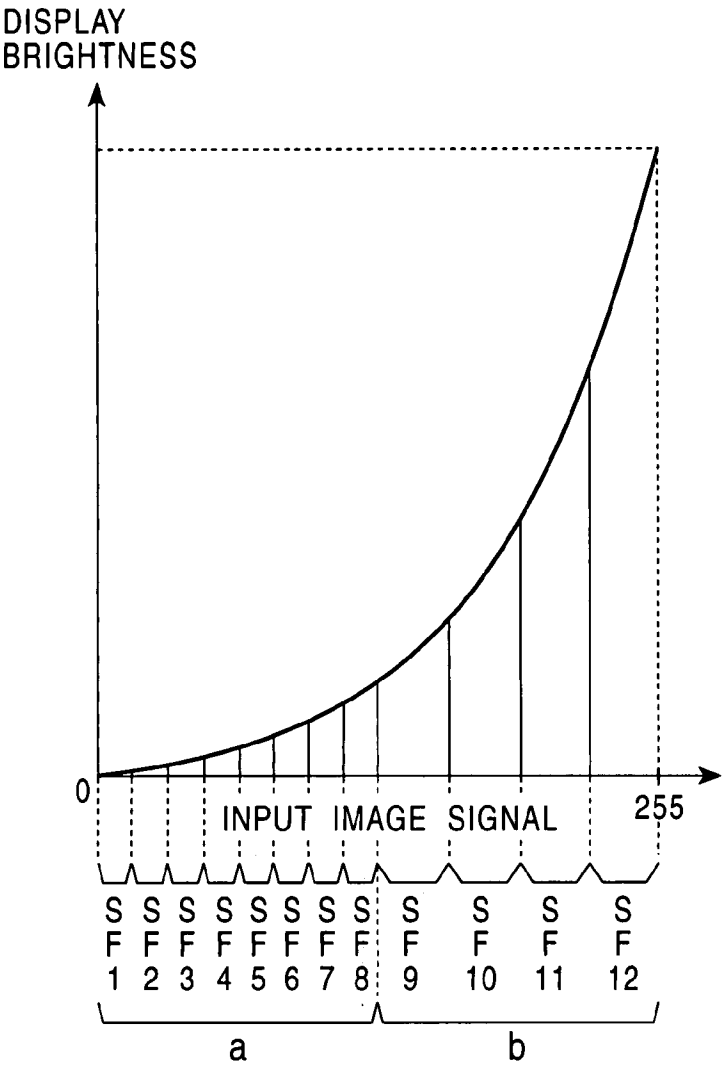
FIG. 8A shows the display brightness levels of an image actually displayed on the PDP when the image signal of FIG. 5A is input.

By means of this brightness level conversion, a larger number of subfields are allocated to a brightness range (brightness region) in which the frequency, indicating the number of occurrences of the same brightness in pixel data for one field, is high, and a smaller number of subfields are allocated to a brightness range with lower frequency. For example, if the brightness frequency distribution of the image signal for one field is as shown in FIG. 5A, a conversion characteristic curve indicated by the dashed line in FIG. 2 is adopted in the brightness level conversion circuit 2. Based on the pixel data PD1 converted using this conversion characteristic curve, for example, the eight subfields SF1 to SF8 are allocated for driving the low brightness region a shown in FIG. 5A, and four subfields SF9 to SF12 are allocated for driving the high brightness region b. FIG. 8A shows the display brightness levels of an image actually displayed on the PDP 100 in response to an input image signal, when such modified subfield allocation is employed.

Figure 2:
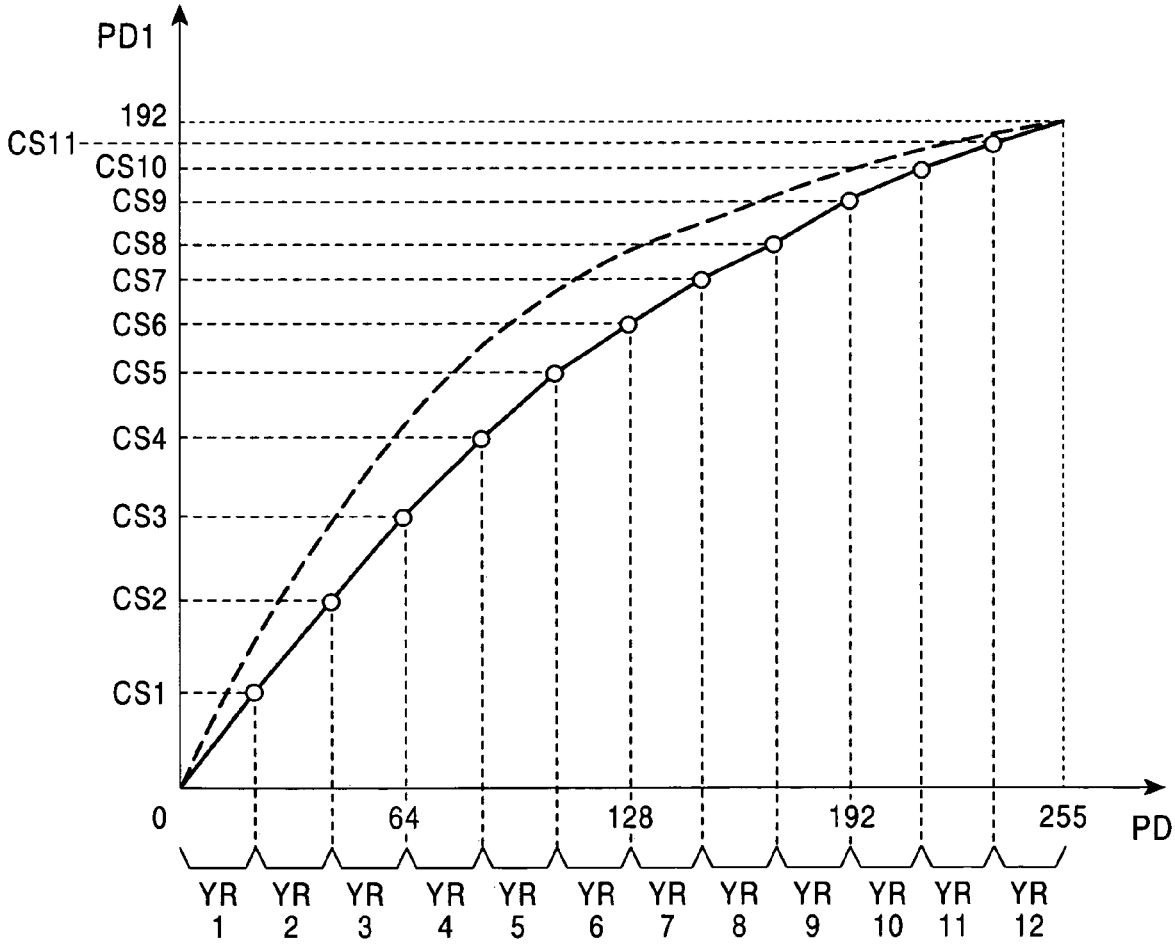
FIG. 2 illustrates conversion characteristic curves for a brightness level conversion circuit shown in FIG. 1.
Figure 8B:
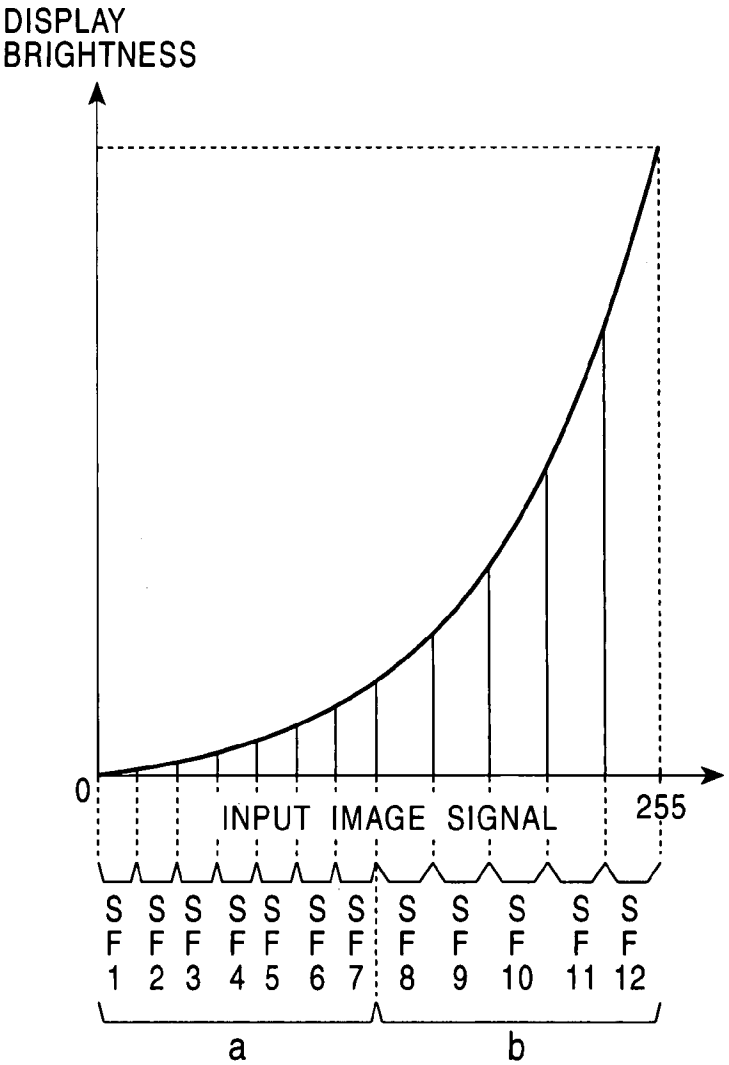
FIG. 8B shows the display brightness levels of an image actually displayed on the PDP when the image signal of FIG. 6A is input.

On the other hand, when the brightness frequency distribution of one field's worth of an image signal is as shown in FIG. 6A, a conversion characteristic curve shown by the solid line in FIG. 2 is used in the brightness level conversion circuit 2. Based on the pixel data PD1 converted using this conversion characteristic curve, for example, the seven subfields SF1 to SF7 are allocated for driving the low brightness region a shown in FIG. 6A, and the five subfields SF8 to SF12 are allocated for driving the high brightness region b. FIG. 8B shows the display brightness levels for an image actually displayed on the PDP 100 in response to an input image signal, when such subfield allocation is employed.

As described above, for at least two brightness regions, the number of subfields employed for emission at respective brightness levels within each brightness region is adjusted, based on brightness frequency data indicating the frequencies of the same brightness in a brightness distribution for each of fields of an input image signal. By this adjustment operation, the higher the frequencies of brightnesses contained in a brightness region, the greater is the number of subfields allocated to the brightness region, so that satisfactory grayscale representation appropriate to the vision characteristics of humans is achieved. Further, when there is an extremely high frequency in a particular brightness region, the logarithmic conversion circuit 32 and clipping circuit 33 prevent a greater number of subfields than necessary from being allocated to that brightness region (division/section). As a consequence, an appropriate number of subfields are allocated to a low-frequency brightness region, and satisfactory grayscale representation is achieved.

This application is based on a Japanese Patent Application No. 2003-28181, and the entire disclosure thereof is incorporated herein by reference.

What is claimed is:

1. A display device including a display panel, wherein each field of an image signal is divided into a plurality of subfields, the display panel includes a plurality of pixel cells for each pixel, and grayscale display is performed by causing emission in the pixel cells of the display panel, in each of the subfields, based on pixel data of the pixels derived from the image signal, the display device comprising:

a brightness frequency data circuit for generating brightness frequency data indicating a number of pixels at each of the same brightnesses in a brightness distribution for each field of the image signal;

a logarithmic conversion circuit for performing logarithmic conversion processing on the brightness frequency data and generating logarithmic-converted brightness frequency data;

a clipping circuit for generating level-limited brightness frequency data, by converting the logarithmic-converted brightness frequency data into a prescribed upper limit when the logarithmic-converted brightness frequency data exceeds the prescribed upper limit, and by converting the logarithmic-converted brightness frequency data into a prescribed lower limit when the logarithmic-converted brightness frequency data is smaller than the prescribed lower limit;

a cumulative brightness frequency data circuit for obtaining cumulative brightness frequency data corresponding to each brightness level, by accumulating the level-limited brightness frequency data of each brightness level, in the order of increasing or of decreasing brightness levels;

a delimiter value generation circuit for determining a delimiter value for each neighboring subfields, based on the cumulative brightness frequency data; and, a driving controller for grayscale driving of the pixel cells through each of the subfields, which are set using the delimiter values.

2. The display device according to claim 1, wherein the driving controller includes:

an averaging circuit for performing cyclic low-pass filtering processing on the delimiter value for each subfield generated based on the image signal, and using the filtered delimiter value as an averaged delimiter value; and, a brightness level modification unit for modifying brightness levels expressed by the pixel data, using a conversion characteristic based on the averaged delimiter values.

3. The display device according to claim 1, wherein the clipping circuit sets the upper limit such that a spacing between neighboring averaged delimiter values is not more than a prescribed spacing, and sets each of the average values of the logarithmic-converted brightness frequency data as the lower limit.

* * * * *